United States Patent [19]

Garcia et al.

[11] 4,125,101

[45] Nov. 14, 1978

[54] FUEL INJECTION SYSTEM

[75] Inventors: Hector L. Garcia, Highland Park; Edward F. Hajdas, Chicago, both of Ill.

[73] Assignee: Hector L. Garcia, Highland Park, Ill.

[21] Appl. No.: 756,323

[22] Filed: Jan. 3, 1977

[51] Int. Cl.[2] ..... F02M 41/02

[52] U.S. Cl. ..... 123/139 AW; 261/36 A; 261/DIG. 39

[58] Field of Search ..... 123/139 AW, 139 AK, 123/139 AT, 139 BF, 139 BE; 261/36 A, 116, DIG. 39

[56] References Cited

U.S. PATENT DOCUMENTS

| | | | |
|---|---|---|---|
| 2,183,875 | 12/1939 | Smith | 123/139 BF |
| 2,387,277 | 10/1945 | L'Orange | 123/139 AW |
| 2,791,205 | 5/1957 | Platner et al. | 123/139 AW |
| 2,892,453 | 6/1959 | Stoll | 123/139 AW |
| 2,895,463 | 7/1959 | Powell et al. | 123/139 AW |
| 2,901,031 | 8/1959 | Powell et al. | 123/139 AW |
| 2,913,231 | 11/1959 | Powell et al. | 123/139 AW |
| 2,957,464 | 10/1960 | Dolza | 123/139 AW |
| 3,020,905 | 2/1962 | Göschel et al. | 123/139 AW |
| 3,145,699 | 8/1964 | High | 123/139 AW |
| 3,519,407 | 7/1970 | Hilborn | 123/139 AT |
| 3,587,546 | 6/1971 | Fessenden | 123/139 AW |

*Primary Examiner*—Charles J. Myhre
*Assistant Examiner*—Andrew M. Dolinar
*Attorney, Agent, or Firm*—Dressler, Goldsmith, Clement, Gordon & Shore Ltd.

[57] ABSTRACT

A fuel injection system for internal combustion engines that includes a gasoline metering valve to which gasoline is delivered by a fuel pump adapted to maintain a given pressure at a substantially constant rate of flow, and from which gasoline flows at a rate determined by the position of a throttle rod connected with the metering valve. The gasoline leaving the metering valve is conducted under pressure directly to a gasoline distribution block, where it is divided into substantially equal streams for delivery to discharge nozzles that project a narrow spray of finely divided gasoline droplets into the cylinder head intake chambers of the respective cylinders of the internal combustion engine.

Each discharge nozzle and the spray it emits are positioned so that no substantial quantity of gasoline droplets in the narrow spray emitted by the nozzle will come into contact with the interior walls that define the cylinder's individual passage in the intake manifold and the associated intake port.

The angle at which the narrow spray of fine gasoline droplets flares out as it leaves the outlet orifice of each discharge nozzle is small — no greater than about 10° and preferably no greater than 2° at a distance from the outlet orifice of the nozzle about 40 times the orifice diameter. The width of the spray as it passes through the intake valve opening associated with the nozzle, under the action of the additional vacuum produced in the cylinder by the withdrawing piston, is also specified in terms of the dimensions of the valve opening and the valve stem that is positioned in the opening.

Each discharge nozzle has an outlet orifice of a size selected to produce the desired balance of fuel economy and high performance for the particular engine with which the fuel injection system is used. Orifice sizes are specified for engines of various rated horsepowers or engine displacement according to the type of ground vehicle involved — from lawn mower and go-cart engines through motorcycles, 4-, 6- and 8-cylinder standard motor vehicles, and 8-cylinder racing cars.

46 Claims, 20 Drawing Figures

FIG. 5
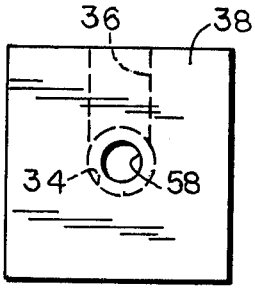
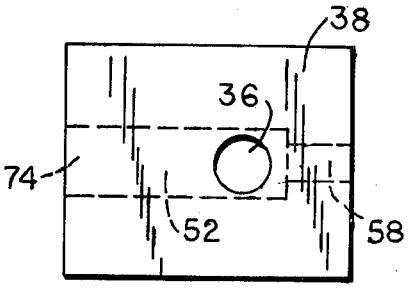
FIG. 6
FIG. 7
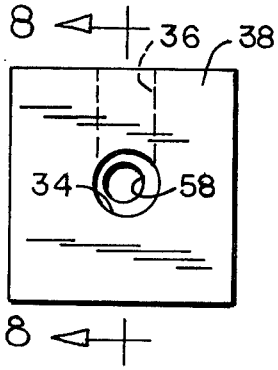
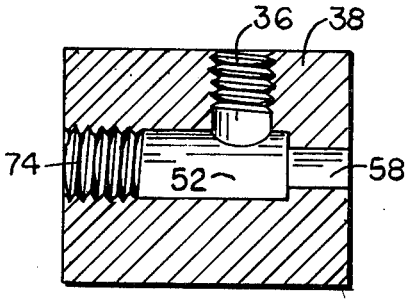
FIG. 8
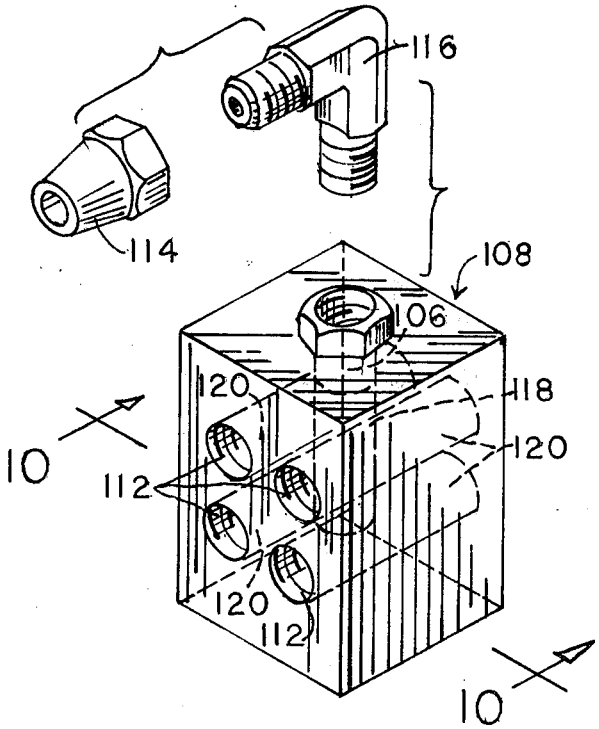
FIG. 9
FIG. 10
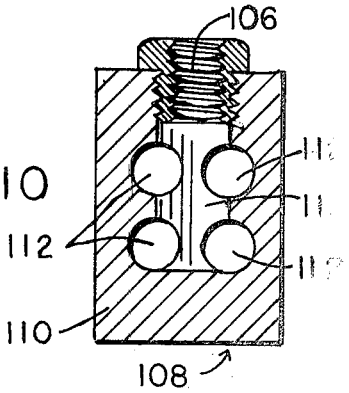
FIG. 11
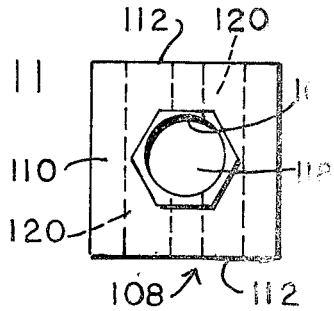

RELATIONSHIP OF LAWN MOWER AND GO-CART ENGINE (.25 THRU 60 H.P.) TO NOZZLE ORIFICE SIZE

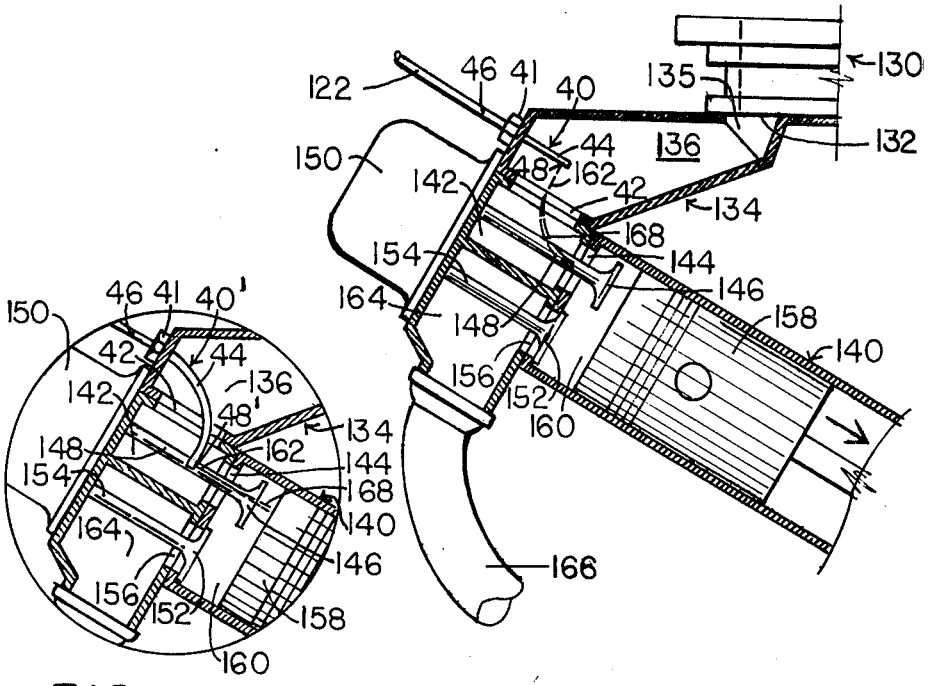
FIG. 18
FIG. 19
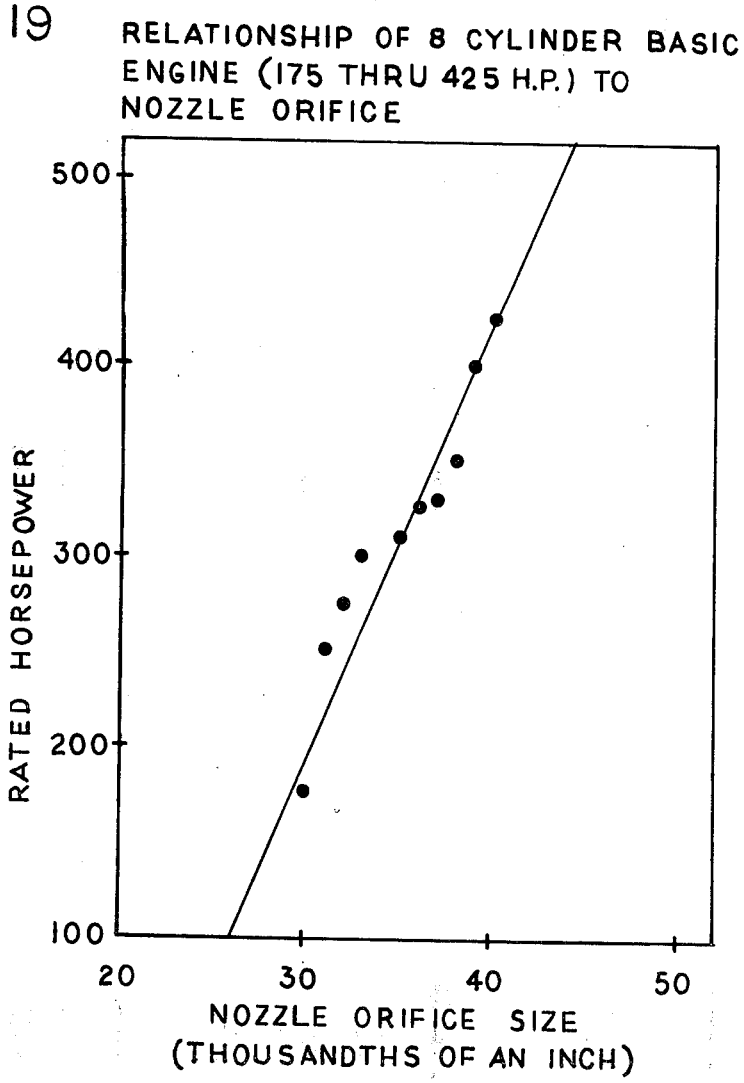
FIG.16

FUEL INJECTION SYSTEM

This invention relates to (1) a fuel injection system for use with a gasoline internal combustion engine, and (2) to a system for converting an existing carburetor type gasoline engine into a fuel injection type engine.

A number of fuel injection systems for gasoline internal combustion engines are known, but none of them provides the combination of features or the simple, effective mode of operation that is made available by the present invention. Known fuel injection systems include, for example, those disclosed in the patents to Winfield U.S. Pat. No. 2,136,959, L'Orange U.S. Pat. No. 2,387,277, Powell et al. U.S. Pat. Nos. 2,895,463, 2,901,031 and 2,913,231, Taylor et al. U.S. Pat. No. 2,955,582 and Hilborn U.S. Pat. No. 3,519,407.

SUMMARY OF THE INVENTION

The fuel injection system of this invention includes an adjustable gasoline metering valve that is actuated by movement of the throttle rod of the internal combustion engine. A flow of gasoline is delivered to the metering valve by a fuel pump that is adapted to maintain a given pressure at a substantially constant rate of flow. The metering valve is responsive to movement of the throttle rod from its closed to its open position, so that the rate at which gasoline is permitted to pass through the metering valve is increased as the throttle rod is thus moved, and decreased when the throttle rod is moved in the opposite direction.

The gasoline leaving the adjustable metering valve is conducted under pressure directly to a gasoline distribution block. The distribution block has an inlet opening that communicates at all times with a central chamber, and passageways leading from that chamber to outlet openings, all of which openings have an equal cross-sectional area. When filled with gasoline, the distribution block divides the gas flow into substantially equal fractions, for distribution to and introduction into discharge nozzles that are located adjacent the intake ports of the respective cylinders of the internal combustion engine. Each of these discharge nozzles has an outlet orifice to provide a free and direct liquid flow path at all times from the interior to the exterior of the nozzle.

When gasoline is introduced at a predetermined operating pressure into the interior of the nozzle just described, a narrow spray of finely divided gasoline droplets is emitted from a specially designed and positioned outlet orifice in the discharge nozzle. One of the important features of this invention is that this spray of finely divided gasoline droplets must be so narrow that it has an angle of flare, measured from one side of the spray to the other at a distance from the discharge orifice approximately equal to 40 times the diameter of the orifice and with its vertex at said orifice, that is no greater than about 10° when the nozzle is tested in an ambient vapor pressure of 1 atmosphere with gasoline introduced into the nozzle at the predetermined operating pressure. Improved results are achieved when the angle thus defined is no greater than about 5°, and best results when it is no greater than about 2°.

A second important feature of this invention is that the narrow spray of finely divided droplets emitted by each discharge nozzle must be projected into the cylinder head intake chamber of the cylinder with which the nozzle is associated along a path that avoids bringing any substantial quantity of the droplets into contact with the interior walls that define the cylinder's individual passage in the intake manifold of said engine and the walls that define the cylinder's associated intake port. The nozzle may if desired be positioned with its orifice located in the cylinder head intake chamber itself, so that the spray is introduced directly into that chamber. Of, if desired, the nozzle may be positioned adjacent the intake port of the cylinder, with the spray being projected into the cylinder head intake chamber through the intake port.

As a result of this second feature just described, substantially all the narrow spray of liquid droplets from the discharge nozzle orifice either impinges upon the walls defining the cylinder head intake chamber or upon the inlet valve or valve stem, or passes directly through the inlet opening into the cylinder (when the inlet valve is open), to impinge there upon the walls of the cylinder. Since the walls of the cylinder head and intake chamber and the intake valve and associated valve stem are typically all at a temperature of approximately 180° - 200° F. during operation of a gasoline internal combustion engine, and the walls of the cylinder are at an even higher temperature, the gasoline droplets that make up the fine spray vaporize almost immediately upon striking these hot surfaces. Thus there is with this invention little or no accumulation of liquid gasoline to run down the wall of the cylinder head intake chamber or cylinder, and there is none of the combustion problem that would accompany any such accumulation of liquid fuel.

Prior to the present invention, this mode of vaporizing the liquid gasoline by causing a narrow stream of gasoline droplets to strike a high temperature surface was not considered feasible. In fact, the accepted view was just the contrary, i.e., that such a spray "should have little penetration but good atomization" (Burman and De Luca, *Fuel Injection and Controls for Internal Combustion Engines* (Simmons-Boardman Publishing Corporation, 1962), pages 190–191). To achieve good atomization of the liquid fuel emitted by the discharge nozzle and good distribution of the resulting liquid droplets throughout the quantity of air with which the droplets are to be mixed, the gasoline droplets utilized in the manifold fuel injection systems of the prior art are emitted from the discharge nozzle in a spray having an included angle of 30°–60°, much greater than the included angle of 2°–10° for the spray of gasoline droplets in the fuel injection system of this invention (id.).

In the operation of the system of this invention, substantially no liquid gasoline strikes the walls of any given cylinder's individual passage in the intake manifold of the gasoline internal combustion engine, which walls are typically at only about 60° F. In addition, because of the rapid vaporization of the gasoline droplets when they strike the very hot surfaces that are described above as typically being at about 180° - 200° F. or higher, no substantial quantity of liquid gasoline accumulates on or flows down the walls that define the intake port, the cylinder head intake chamber, and the cylinder itself.

Avoiding any substantial flow of liquid gasoline down the walls of the cylinders is extremely important for several reasons. First, this avoids washing lubricating oil down off the walls, and thus helps maintain the lubrication between those walls and the piston rings as the piston undergoes its reciprocal motion within the cylinder. Second, it greatly improves the combustion efficiency of the engine, since vaporized gasoline of course burns much more readily than a film of liquid gasoline spread upon the cylinder walls. It is believed that the presence of substantial films of liquid gasoline upon the cylinder walls reduces the combustion efficiency of a gasoline internal combustion engine to something like only 70 to 80 percent, compared to the 100 percent combustion that is achieved with the fuel injection system of this invention. Third, keeping liquid gasoline substantially off the cylinder walls avoids the accumulation of unburned liquid gasoline at the bottom of the cylinders, and thus avoids continued running of the engine for a period after the ignition has been turned off (so-called "dieseling"). Fourth, avoiding the accumulation of unburned liquid gasoline at the bottom of the cylinders avoids the leakage of any such gasoline out through the seal between the piston rings and the cylinder walls into the oil pan, where it is not only wasted, but in addition presents a definite fire hazard.

An additional important feature of the fuel injection system of this invention is the provision of means to limit the pressure of the gasoline delivered to the discharge nozzles. This pressure is preferably limited to no more than about 7 p.s.i.g. for ground automotive vehicles of standard speed and acceleration, which is the pressure at which gasoline fuel pumps typically operate in commercially available automobiles, trucks and other motor vehicles. The pressure for airplane engines is preferably limited to no more than about 30 p.s.i.g. The pressure for racing car engines is preferably limited to no more than about 50 p.s.i.g., which is well below the pressure (often 60 to 80 p.s.i.g.) at which most fuel injection systems are operated for such cars.

The maintenance of the indicated maximum pressures can be achieved through use of a pressure regulator to be inserted in the conduit leading from the fuel pump to the gasoline metering valve or in some other appropriate point in the fuel injection system. Of, if desired, the fuel pump employed can be self-regulating to provide the desired pressure in the liquid gasoline it delivers.

Keeping the operating pressure for this fuel injection system at low levels such as those indicated makes it much easier, especially with already existing engines, to avoid leaks at various sealing points throughout the system. With a higher pressure fuel injection system leaks are likely to occur, for example, at the piston rings, which will dilute the lubricating oil on the cylinder walls and wash a portion of the oil down into the oil pan and create a fire hazard there. Keeping the operating pressure low will also avoid the stretching and weakening of any rubber lines in the system that can occur with higher pressures. And it is further desirable to avoid high operating pressures because they would tend to magnify the effects of small obstructions in the fuel lines, and the resulting imbalance in the flow of gasoline to the various cylinders, which can produce off balance operation of the engine through irregular gas feed to different cylinders, with accompanying scoring of the cylinder walls, the cocking of pistons, and strain on the bearings and connecting rods.

Another feature of the fuel injection system of this invention is the narrow width of the spray of droplets of gasoline measured at the point where the spray passes through the intake valve — when it is open — of the cylinder with which the discharge nozzle from which the spray is emitted is associated. At this point it is desirable that the spray of droplets be substantially narrower than the diameter of the intake valve opening through which the spray passes as it is drawn into the cylinder from the cylinder head intake chamber. The preferred width of the spray at this point is substantially narrower than the radius of the annular opening that is present around the valve stem, or in other words substantially narrower than the radius of the entire valve opening minus the radius of the stem of the inlet valve that is positioned in the valve opening.

This limitation of the width of the spray of droplets until the spray has been drawn into the cylinder helps to maintain the integrity of the spray as a group of relatively closely spaced droplets until they have actually moved into the enclosed space within the cylinder itself, a result which is inconsistent with the general effort in both carburetor systems and other fuel injection systems to get the suspended liquid droplets as widely dispersed in the surrounding air as early as possible. Not only does this feature of the present invention run counter to the teaching of the prior art, but it is believed that it helps to produce the surprisingly great increase in the combustion efficiency — as much as 25 percent or more — of this fuel injection system when compared to prior art systems.

Another important feature of the fuel injection system of this invention is the selection of the proper size for the outlet orifice of the discharge nozzle to provide a desirable balance between fuel economy and engine performance. Too large an outlet orifice cannot provide economical operation because excess gasoline is difficult or impossible to burn. In addition, when the engine is not running, gasoline will leak out of an orifice that is too large, and accumulate as unburned liquid in the cylinder head intake chamber and its associated cylinder, unless a shut-off valve is provided. On the other hand, too small an orifice will keep the quantity of gasoline fed to the cylinder below the level that is required for the engine to deliver the desired power.

The size of the outlet orifice of the discharge nozzle in the preferred form of this invention is selected according to the type of the engine and the rated horsepower or engine displacement of the engine. This is an important feature of the present invention, and a novel feature not found in any prior art known to us. In all three prior art mechanical and fuel injection systems with which we are familiar that are employed with gasoline internal combustion engines, the size of the outlet orifices in the discharge nozzles is the same for a given engine type regardless of the rated horsepower of the particular engine involved.

Formulas for specific orifice sizes that produce a desirable balance between fuel economy and engine performance are set forth below in this specification. Different formulas are employed that define a preferred diameter size for engines of various rated horsepowers or engine displacements according to the type of vehicle involved — from lawn mower and go-cart engines through motorcycles, 4-, 6- and 8-cylinder standard motor vehicles, and 8-cylinder racing cars.

The minimum suitable diameter for the outlet orifice in the discharge nozzle of the fuel injection system of this invention for use in the smallest gasoline internal combustion engine is about 0.0005". The maximum suitable diameter for the outlet orifice is the diameter at which the capillary action between the walls defining the orifice (formed, for example, of corrosion-free steel tubing) and the gasoline contained therein prevents flow of gasoline from the orifice when the orifice is facing in a generally downward direction and the liquid inside the discharge nozzle is at the same pressure as the vapor pressure outside the nozzle. The diameter of the outlet orifice is usually larger the higher the rated horsepower of the engine. The size of the outlet orifice is the same for each cylinder of a given engine.

As an example, with ground motor vehicles of standard speed and acceleration, such as passenger automobiles or trucks, the operating pressure of the fuel injection system of this invention is preferably about 7 p.s.i.g. For such pressure, the outlet orifices of the discharge nozzles have diameters falling in the range between about 0.025" to about 0.055", with the diameter being larger the higher the rated horsepower of the engine. At the maximum orifice size of 0.055", but not with any substantially larger size, it has been found that the capillary action between the walls defining the orifice and the gasoline contained therein prevents flow of gasoline from the orifice when the outlet orifice faces in a generally downward direction and the liquid inside the nozzle is at the same pressure as the vapor pressure outside the nozzle.

The indicated standard for maximum outlet orifice size prevents leakage from the orifice to the cylinder head intake chamber when the ignition switch is turned off, and the engine is no longer running. The indicated maximum size limitation thus helps to prevent undesirable accumulation of liquid in the cylinder head intake chamber, with all the disadvantages that have been pointed out above for such accumulations.

When the fuel injection system of this invention is employed with a gasoline internal combustion engine for a standard 8-cylinder motor vehicle, which engines conventionally have a fuel pump that delivers gasoline at a pressure of about 7 p.s.i.g., a cut-off valve is employed for blocking flow of gasoline, when the engine is not running, from any outlet orifice having a diameter larger than about 0.055", if the fuel pump is electrically operated and the ignition key is left in the "On" position.

A pressure responsive by-pass valve is connected with the fuel intake line adjacent the upstream side of the adjustable gasoline metering valve, to provide a return fuel path back to the gasoline tank. The by-pass valve is adapted to allow the passage of liquid into the return fuel line substantially at the given pressure at which the fuel pump is adapted to deliver gasoline to the metering valve at a substantially constant rate, but to block the passage of liquid at pressures substantially below that given pressure. By this means, any excess gasoline that is pumped from the fuel pump to the adjustable metering valve, but is not permitted to pass through that valve, is conducted back to the gasoline tank.

BRIEF DESCRIPTION OF DRAWINGS

The invention will now be described with reference to the attached drawing, in which:

FIG. 5 is an end view, from the right in FIG. 3, of the body member of the gasoline metering valve of FIG. 3;

FIG. 6 is a top plan view of the metering valve body member of FIG. 5;

FIG. 7 is an end view of the same body member, taken from the left in FIG. 3;

FIG. 8 is a sectional view of the same metering valve body member, taken generally along the line 8—8 in FIG. 7;

FIG. 9 is an exploded perspective view of one embodiment of a gasoline distribution block that may be employed with the fuel injection system of FIG. 1;

FIG. 10 is a cross-sectional view taken generally along the line 10—10 in FIG. 9;

FIG. 11 is a top plan view of the gasoline distribution block of FIG. 9;

FIG. 16 is a similar graph for standard 8-cylinder gasoline internal combustion engines;

FIG. 18 is a side elevation, partly cut away, showing the arrangement of the discharge nozzle adjacent the intake port of the fuel injection system of this invention;

FIG. 19 is a fragmentary sectional view of another form of discharge nozzle with its outlet orifice located in the cylinder head intake chamber.

DETAILED DESCRIPTION OF ONE EMBODIMENT OF THIS INVENTION

Figure 1:
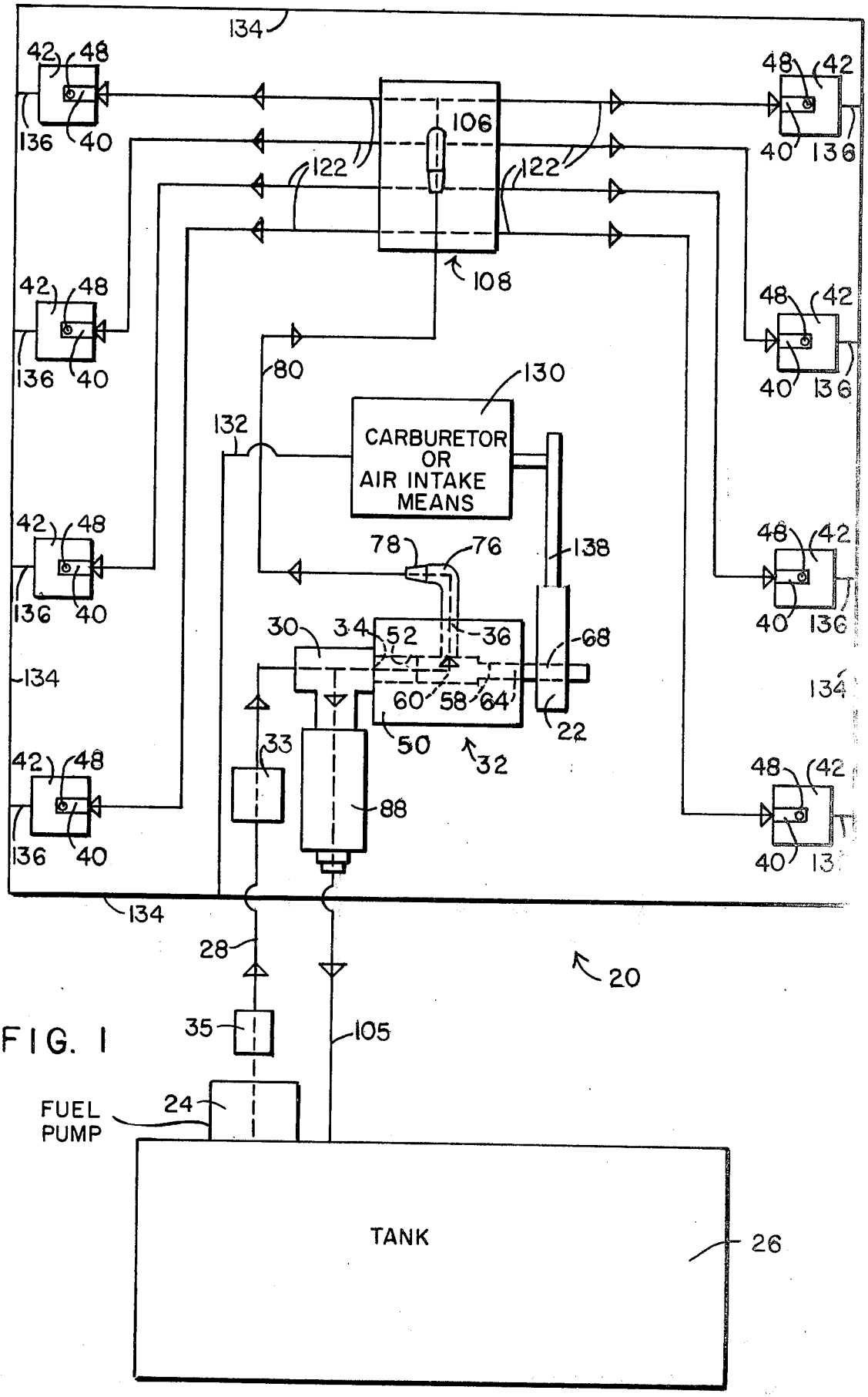
FIG. 1 is a diagrammatic drawing of the fuel injection system of this invention.

FIG. 1 shows a fuel injection system 20 for use with a conventional gasoline internal combustion engine such as that of an 8-cylinder automobile.

Overall Construction

With this system, throttle rod 22 is actuated by the operator of the vehicle to determine the rate at which gasoline is introduced into the cylinders of the engine. Throttle rod 22 is movable from a closed to an open position, to increase the amount of gasoline fed to the cylinders, as the operator desires.

Gasoline is continuously pumped by electric fuel pump 24 from gasoline tank 26 through intake fuel line 28 when the ignition key is in the "On" position. The pump, which is adapted to pump gasoline at a given pressure with a substantially constant rate of flow, delivers gasoline through Tee 30 to adjustable metering valve 32. Fuel filter 33 is included in intake fuel line 28 to remove any suspended solid particles that might interfere with the fuel injection process. If desired, pressure regulator 35 may be included in fuel line 28 to maintain the pressure in that line at a level no higher than a predetermined operating pressure.

Adjustable metering valve 32 is adapted to be actuated by movement of throttle rod 22. Valve 32 has an inlet opening 34 for receiving gasoline under pressure from fuel pump 24 through intake fuel line 28, and an outlet opening 36 from which metered amounts of gasoline may flow.

As will be explained more fully below, these metered amounts are divided at a gasoline distribution block into substantially equal streams of liquid which are conducted to discharge nozzles 40 at intake ports 42 of the respective cylinders of the internal combustion engine with which the fuel injection system of this invention is employed.

Discharge Nozzles

Figures 2, 3, 4:
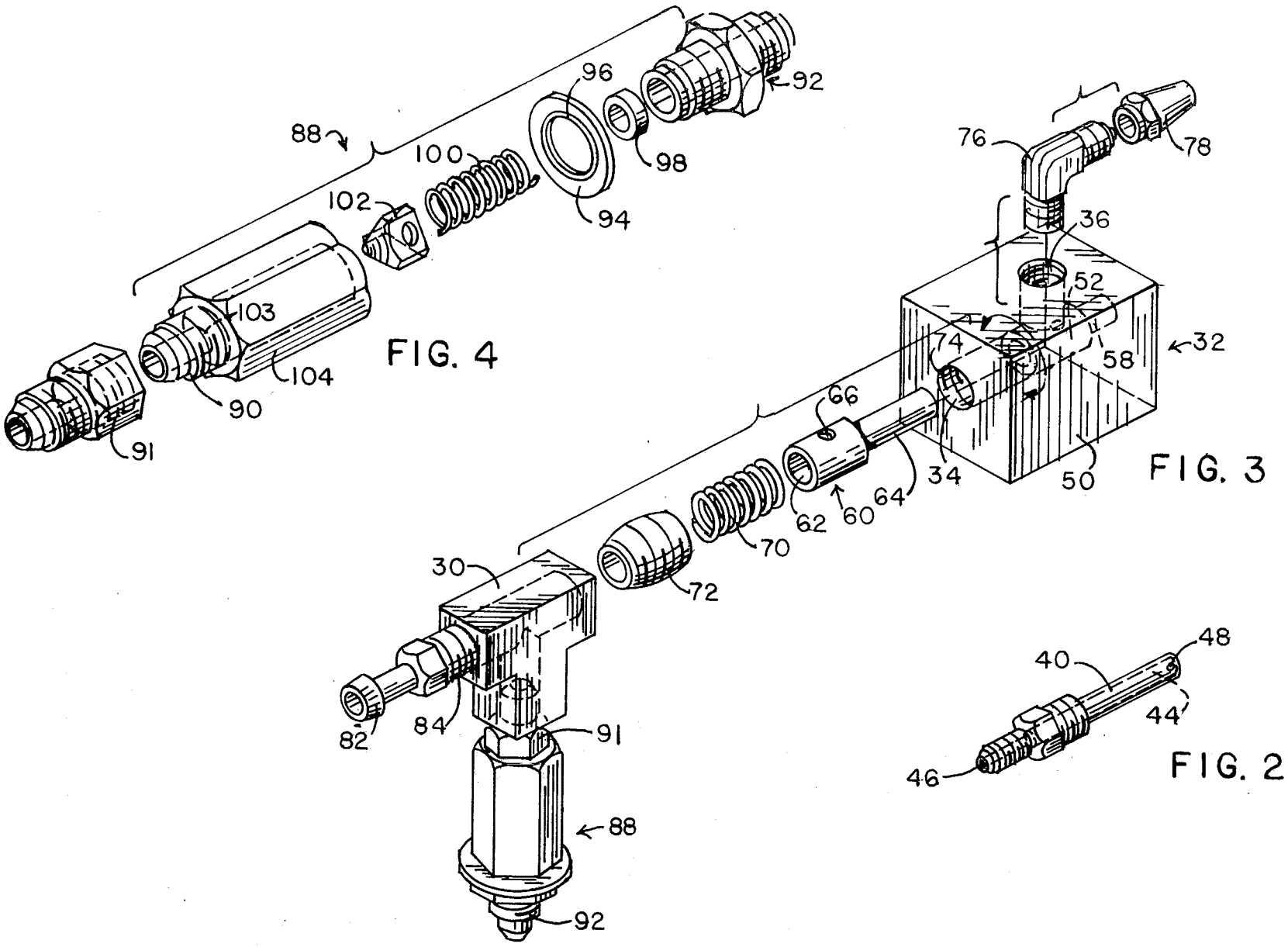
FIG. 2 is a perspective view of a discharge nozzle employed in the fuel injection system of FIG. 1.
FIG. 3 is an exploded perspective view of one embodiment of an adjustable gasoline metering valve, together with a perspective view of a pressure responsive by-pass valve, which may be used in the fuel injection system of FIG. 1.
FIG. 4 is an exploded perspective view of the by-pass valve shown in FIG. 3.

As seen in FIG. 2, each discharge nozzle 40 includes a hollow shank 44 whose exterior wall is substantially free of indentations. In the embodiment shown, elongated nozzle 40 has an exterior wall in the form of a right circular cylinder. Nozzle 40 may if desired have a curved or bent configuration, or any other suitable form, so long as it is properly positioned as explained above to avoid directing any substantial quantity of the liquid droplets emitted from the outlet orifice of the nozzle against the walls defining the associted individual passage in the intake manifold and the intake port leading into the associated cylinder head intake chamber.

The discharge nozzle has an inlet opening 46 at one end that communicates between the exterior and the interior of hollow shank 44. The other end of nozzle shank 44 is closed except for cylindrically shaped outlet orifice 48, which provides a free and direct flow path at all times from the interior of shank 44 for emission of a narrow spray of finely divided gasoline droplets from the discharge nozzle when a flow of gasoline under a predetermined operating pressure is introduced into hollow shank 44 and the passages and chamber of the system referred to above maintain their usual continuously present vacuum. In the nozzle of FIG. 2, outlet orifice 48 is located in the side wall of the nozzle, and the mean direction of discharge of the narrow spray of finely divided gasoline droplets is generally perpendicular to the longitudinal axis of shank 44.

As best seen in FIG. 18 below, in the embodiment illustrated each discharge nozzle 40 is positioned adjacent to and in operative communication with its respective intake port 42 of one of the cylinders of the internal combustion engine with which the fuel injection system of this invention is used. In FIG 18, the narrow spray of finely divided gasoline droplets discharged from nozzle orifice 48 is projected directly through intake port 42 and into its associated cylinder head chamber 142. In the embodiment shown in FIG. 19, J-shaped nozzle 40′ emits a spray of liquid droplets through outlet 48′ that is introduced directly into cylinder head intake chamber 142. (The positioning of nozzles 40 and 40′ will be explained in more detail below in connection with the further discussion of FIGS. 18 and 19.)

Gasoline Metering Valve

The construction of the adjustable gasoline metering valve 32 that is employed in the embodiment of the fuel injection system of this invention disclosed in the drawings is best seen in FIG. 3. This embodiment includes a body member 50 having a cylindrical cavity 52 therein. The cavity has an inlet passage 34 and an outlet passage 36, both of which provide fluid communication from cavity 52 to the exterior of body member 50.

Member 50 also defines journal means 58 communicating with the exterior of the body. Rotatably positioned within and complementary in shape to cylindrical cavity 52 is hollow sleeve member 60. One end 52 of the hollow sleeve member communicates with inlet passage 34 of body member 50, and the other end of member 60 terminates in shank 64 which is adapted to rotate within journal means 58.

Hollow sleeve member 60 defines outlet port 66 in its side wall, which port is adapted to move into and out of register with outlet passage 36 of body member 50 as the hollow sleeve is rotated first in one direction and then the other about its longitudinal axis. Rotatable shank portion 64 of the hollow sleeve terminates in a shank portion 68 which extends beyond body member 50 to provide means by which sleeve shank 64 and sleeve member 60 can be rotated about their common longitudinal axis. As indicated in FIG. 1, means are provided for attching shank portion 68 to throttle rod 22, so that movement of the throttle rod will cause sleeve member 60 to rotate about its longitudinal axis.

Sleeve member 60 is held in place in the assembled gasoline metering valve 32 by compression spring 70 and threaded tapered sleeve member 72. Threaded member 72 engages threaded sidewalls 74 of inlet opening 34. Elbow 76 is threadedly engaged with the walls of outlet opening 36 of member 50, and fitting 78 provides a connection at the other end of the elbow with intermediate feed line 80 (Fig. 1).

As will be seen, as outlet port 66 of hollow sleeve member 60 is moved into register with outlet passage 36 of gasoline metering valve 32 when throttle rod 22 is moved from its closed to its open position, the maximum amount of fuel under pressure will be permitted to pass from fuel intake line 28 to intermediate fuel line 80. On the other hand, as outlet port 66 is moved out of register with outlet passage 36 when throttle rod 22 is moved back to its closed position, the amount of liquid permitted to pass through metering valve 32 will be progressively reduced until a minimum rate of flow is established.

By-pass Valve

The upstream end of threaded fitting 72 is connected with one side of Tee 30. The other side of the Tee is connected through appropriate fittings 82 and 84 with intake fuel line 28. The bottom passageway 86 of Tee 30 is connected with pressure responsive by-pass valve 88, which is seen in perspective view in FIG. 3 and in exploded perspective view in FIG. 4.

By-pass valve 88 is a conventional by-pass valve with threaded nipple 90 and threaded fitting 91 at its top end and threaded fitting 92 at its bottom end. Washer 94 and rubber seal 96 are seated against threaded fitting 92 on the outside of the fitting, and hollow cylindrical "pill" member 98 is seated within the interior thereof. Compression spring 100 normally biases movable valve member 102 gainst the walls defining inlet opening 103 in fitting 90 within chamber 104. Compresion spring 100 is selected to adapt by-pass valve 88 to allow the passage of liquid gasoline substantially at the given pressure at which gasoline is delivered by fuel pump 24 to metering valve 32 at the above mentioned constant rate, and to block the passage of liquid at pressures substantially below said given pressure.

Thus, when the liquid pressure in the bottom end of Tee 30 rises to substantially the given rated pressure from fuel pump 24, this pressure overcomes the pressure normally exerted by compression spring 100 against the walls defining opening 103 at the upstream end of by-pass valve 88, and gasoline is permitted to flow through return fuel line 105 back to gasoline tank 26 (FIGS. 1–3). The liquid pressure in Tee 30 is caused to build up in this way when the rate at which gasoline can flow through metering valve 32 is reduced by moving throttle rod 22 towards its closed position, while gasoline continues to be pumped from fuel pump 24 to Tee 30.

The exact gasoline that does not pass through metering valve 32, and will thus not be directly used, is caused in this manner to return to gasoline tank 26 for subsequent use. When sufficient gasoline flows through metering valve 32 because of the actuation of throttle rod 22, the resulting pressure drop in the system reduces the liquid pressure at Tee 30 below the given rated pressure of fuel pump 24, the pressure exerted by compression spring 100 then closes by-pass valve 88, and all the gasoline delivered by intake fuel line 28 passes through the metering valve and ultimately to discharge nozzles 40 and into their associated engine cylinders.

As will be seen from this description, only the required fuel necessary to maintain the engine speed corresponding to the position of throttle rod 22 is allowed to proceed through gasoline metering valve 32. The gasoline rejected by metering valve 32 is caused to return through pressure responsive by-pass valve 88 and return fuel line 105 to fuel tank 26. Thus, any fuel not required for efficient combustion continues to be recycled through the system until it is introduced into the cylinders and burned.

Gasoline Distribution Block

Intermediate fuel line or conduit 80 connects outlet opening 36 of gasoline metering valve 32 directly with inlet opening 106 of gasoline distribution block 108 (FIG. 1). The construction of gasoline distribution block 108 is best seen in FIGS. 9 through 11.

Distribution block 108 includes body member 110 that defines a single inlet opening 106 and as many outlet openings 112 as there are cylinders in the internal combustion engine with which the fuel injection system of this invention is used, which is eight in the embodiment shown. A central chamber 118 is located in the inner portion of body member 110, and has direct communication with inlet opening 106. Internal passageways 120 provide direct fluid communication between central chamber 118 and each of the outlet openings 112. Since each outlet opening 112 has an equal cross sectional area, when chamber 118 is filled with gasoline a substantially equal fraction of the gasoline introduced into inlet opening 106 of distribution block 108 flows out through each outlet opening.

intermediate feed line 80 is threadedly connected with inlet opening 106 of gasoline distribution block 108 through nipple 114 and elbow 116. Gasoline pumped by fuel pump 24 from tank 26, and which passes through adjustable gasoline metering valve 32 as described above, fills central chamber 118 and passes out outlet openings 112. Conduit means 122, each of which connects an outlet opening 112 directly to a discharge nozzle 40, thus delivers to its associated nozzle a metered flow of gasoline under a predetermined operating pressure.

If desired, the walls of body member 110 that define threaded outlet openings 112 in distribution block 108 may be tapered as one moves inward from the exterior face of the distribution block. This will provide a convenient, secure seal for each outlet opening 112 when conduit means 122 is connected between the outlet opening and discharge nozzle 40, thus obviating the use of "O" rings, seals and gaskets, or other sealing means.

Metered Mixture of Gasoline and Air

As explained above, when gasoline is forced under pressure from discharge nozzle 40 through outlet orifice 48, a narrow spray of finely divided gasoline droplets is projected through intake port 42 and into cylinder head intake chamber 142 of a cylinder of the internal combustion engine with which the fuel injection system of this invention is used. Or, if desired, the spray may be emitted from orifice 48' of J-shaped discharge nozzle 40' and projected directly into cylinder head intake chamber 142.

At the same time, a quantity of air is drawn into an air intake device such as conventional carburetor 130, and passes through air inlet 132 to the customary intake manifold 134, from whence it is distributed through individual passages 136 to the respective intake ports 42 of the cylinders of the engine and through the ports into associated cylinder head intake chambers 142. The air is delivered to the respective cylinders at a substantially equal rate through passages 136 in an amount appropriate to the amount of gasoline that, in the manner explained, above, is passed through gasoline metering valve 32.

Throttle rod 22 is connected to carburetor 130 through linkage rod 138. When the throttle rod is moved from its closed to its open position, the rate at which air is delivered by carbureator 130 to the various cylinders of the engine is increased in response to that throttle movement, just as the rate is similarly increased for gasoline passing through metering valve 32. When the throttle rod is moved in the opposite direction, the rate at which the gasoline/air mixture is delivered is decreased.

As already indicated, the fuel injection system of this invention can be installed for use with an existing internal combustion engine having a conventional carburetor 130. Thus, the system described can be utilized to convert an engine having a carburetor that delivers a mixture of air and gasoline to each cylinder of the engine into an engine having its gasoline delivered to the cylinders by fuel injection, with the necessary air for the fuel mixture reaching the cylinders by way of the carburetor. Or, if desired, the fuel injection system of this invention can be installed initially with an internal combustion engine that utilizes an air intake means for delivering air to all its cylinders that is not designed as a conventional carburetor, but simply as a gas metering means.

In either event, when the system has been installed the throttle rod 22 and linkage rod 138 that connect the carburetor or air metering means with gasoline metering valve 32 are adjusted for the correct mixture of air and gasoline at the idling speed of the engine. Thereafter, when throttle rod 22 is moved back and forth between its closed and its open position, the amount of gasoline passing through metering valve 32 and the amount of air taken in by a carburetor or air intake means 130 are both automatically determined by the position of the throttle rod. At all times, of course, the amount of liquid gasoline that is permitted to pass through the entire pressure operated system from fuel pump 24 to and out of the outlet orifices 48 of discharge nozzles 40 or orifices 48' of discharge nozzles 40' is affected by the size of outlet port 66 in hollow sleeve member 60 of metering valve 32, and is ultimately determined by the cross sectional area of orifices 48.

Positioning of Discharge Nozzle

FIG. 18 is a side elevation, partly in section, showing the positioning of discharge nozzle 40 adjacent intake port 42 of cylinder 140, with which the nozzle is associated in this embodiment of the fuel injection system of this invention.

As explained above in connection with FIG. 1, gasoline under pressure is delivered in metered amounts through conduit means 122 to inlet opening 46 of elongated discharge nozzle 40. Nozzle 40 extends within intake manifold 134, and is held in position by means of fitting 41. Outlet orifice 48 provides a free and direct flow path at all times from the interior of shank 44 of nozzle 40 for emission of a narrow spray of finely divided gasoline droplets as described above in this specification.

In the embodiment shown, air intake means 130 is a carburetor from which air in metered amounts passes into intake manifold 134 through air inlet 132. Manifold 134 has a common passage 135 for flow of air therethrough, and individual passages 136 in communication with that passage and branching off to the respective intake ports 42 of cylinders 140 of the gasoline engine. Air and gasoline pass from individual passage 136 through inlet port 42 into cylinder head intake chamber 142, and from there into the interior of cylinder 140.

The gasoline and air pass into cylinder 140 through inlet or intake valve opening 144, in which inlet or intake valve 146 is reciprocally positioned. Valve 146 is carried by valve stem 148, which is actuated by conventional means enclosed in valve cover 150. As is seen from FIG. 18, discharge nozzle 40 is in selective fluid communication with the interior of cylinder 140. Exhaust valve 152 carried by valve stem 154 is positioned in exhaust valve opening 156, and is actuated by the same means that actuates intake valve 146.

In FIG. 18, exhaust valve 152 is shown in its closed position, seated in opening 156. Cylinder 140 is shown in the intake phase of its firing cycle, with piston 158 retreating or withdrawing to create a vacuum in space 160 which is very much greater than the continuously present vacuum of about 21" of mercury in manifold 134, and which supplements that vacuum to pull already vaporized gasoline, and narrow liquid gasoline spray 162 that is emitted by outlet orifice 48 of discharge nozzle 40, down into cylinder 140.

After cylinder 140 has completed the intake phase of its firing cycle and the vacuum produced during that phase has pulled into the cylinder interior the charge of gasoline droplets, vaporized gasoline and air that is to be burned, the cylinder goes through the compression, combustion, and exhaust phases of its firing cycle, during all of which phases inlet valve 146 is in its closed condition, seated in valve opening 144. In the exhaust phase, exhaust valve 152 opens to permit the combustion products to exit from cylinder 140 into cylinder head exhaust chamber 164, from whence the exhaust products pass out through exhaust conduit 166.

Figure 20:
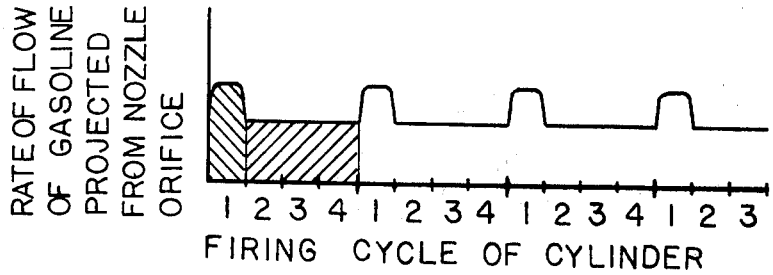
FIG. 20 is a graphical showing of the rate at which gasoline is emitted from a discharge nozzle during the intake, compression, combustion and exhaust phases of the firing cycle of a given cylinder.
Figure 12:
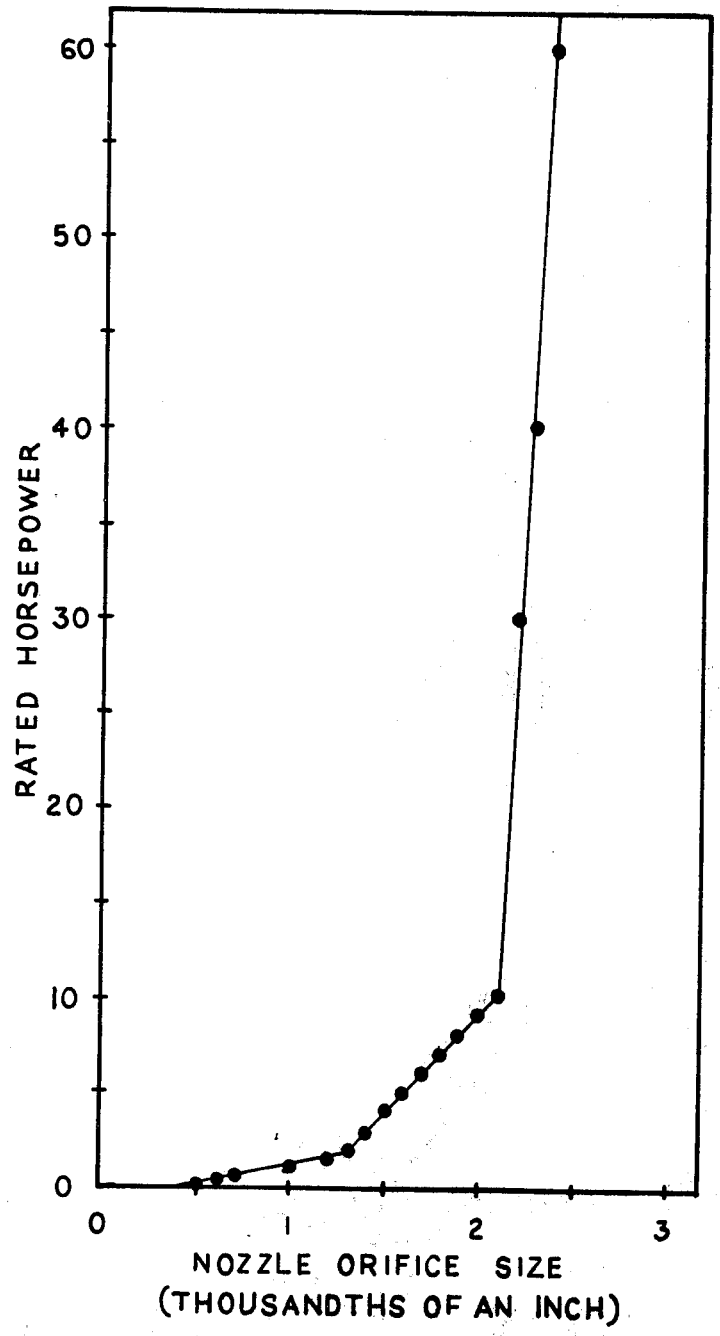
FIG. 12 is a graph showing preferred nozzle orifice sizes for lawn mower and go-cart engines of the indicated rated horsepowers.
Figure 13:
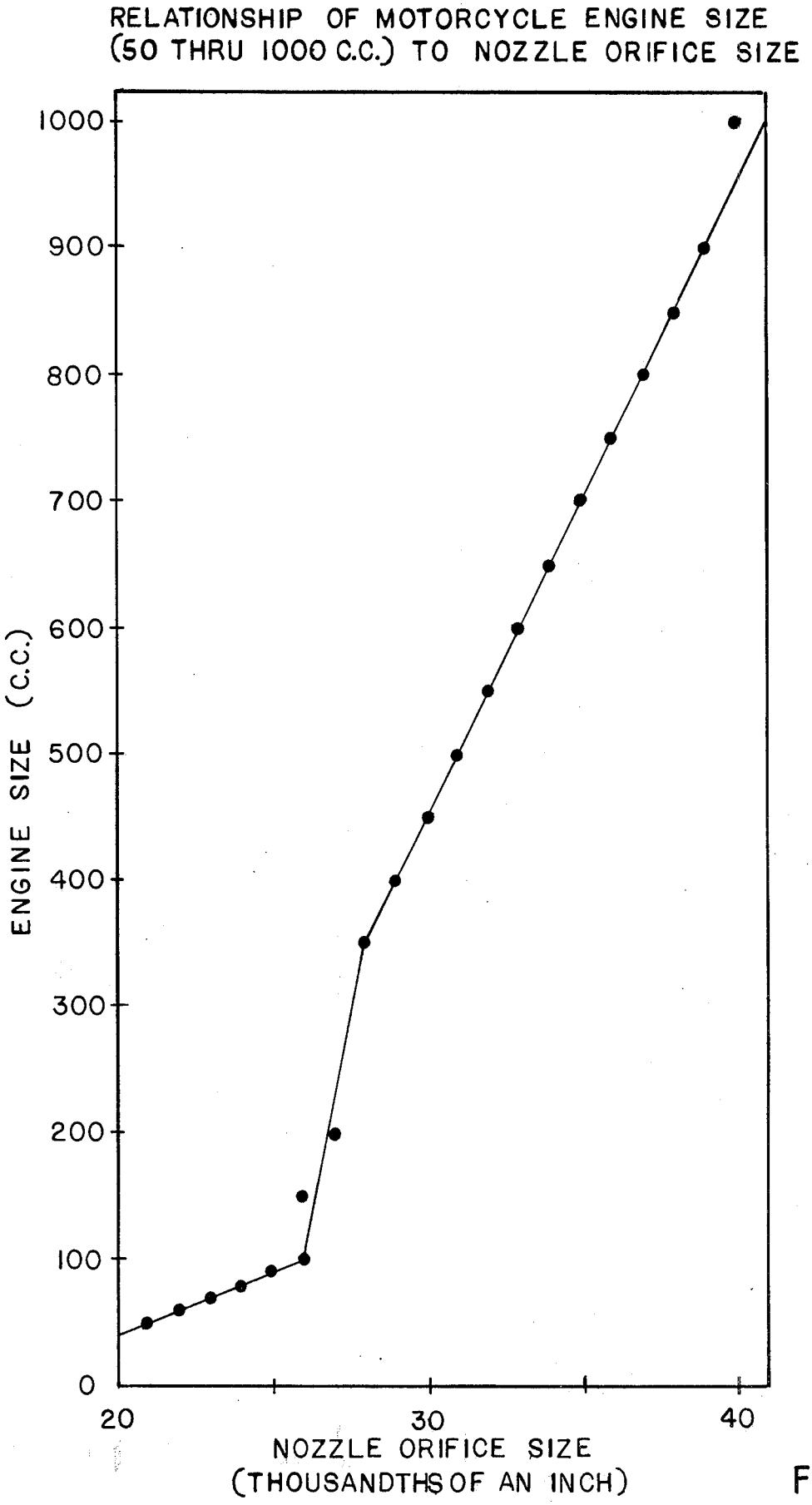
FIG. 13 is a similar graph for motorcycles showing preferred nozzle orifice sizes for motorcycle engines of the indicated engine displacements.
Figure 14:
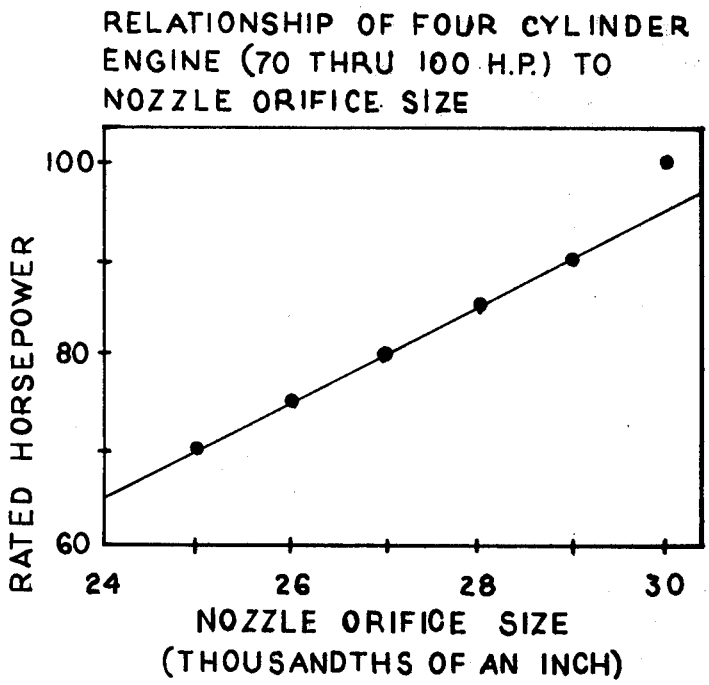
FIG. 14 is a graph similar to FIG. 12, but for standard 4-cylinder gasoline internal combustion engines.
Figure 15:
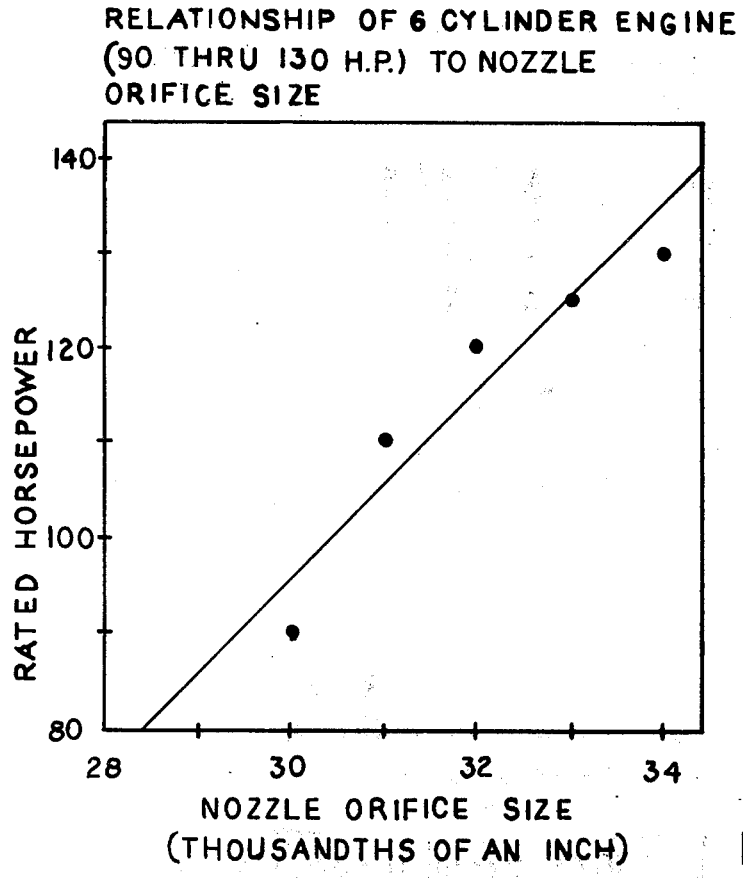
FIG. 15 is a similar graph for standard 6-cylinder gasoline internal combustine engines.
Figure 17:
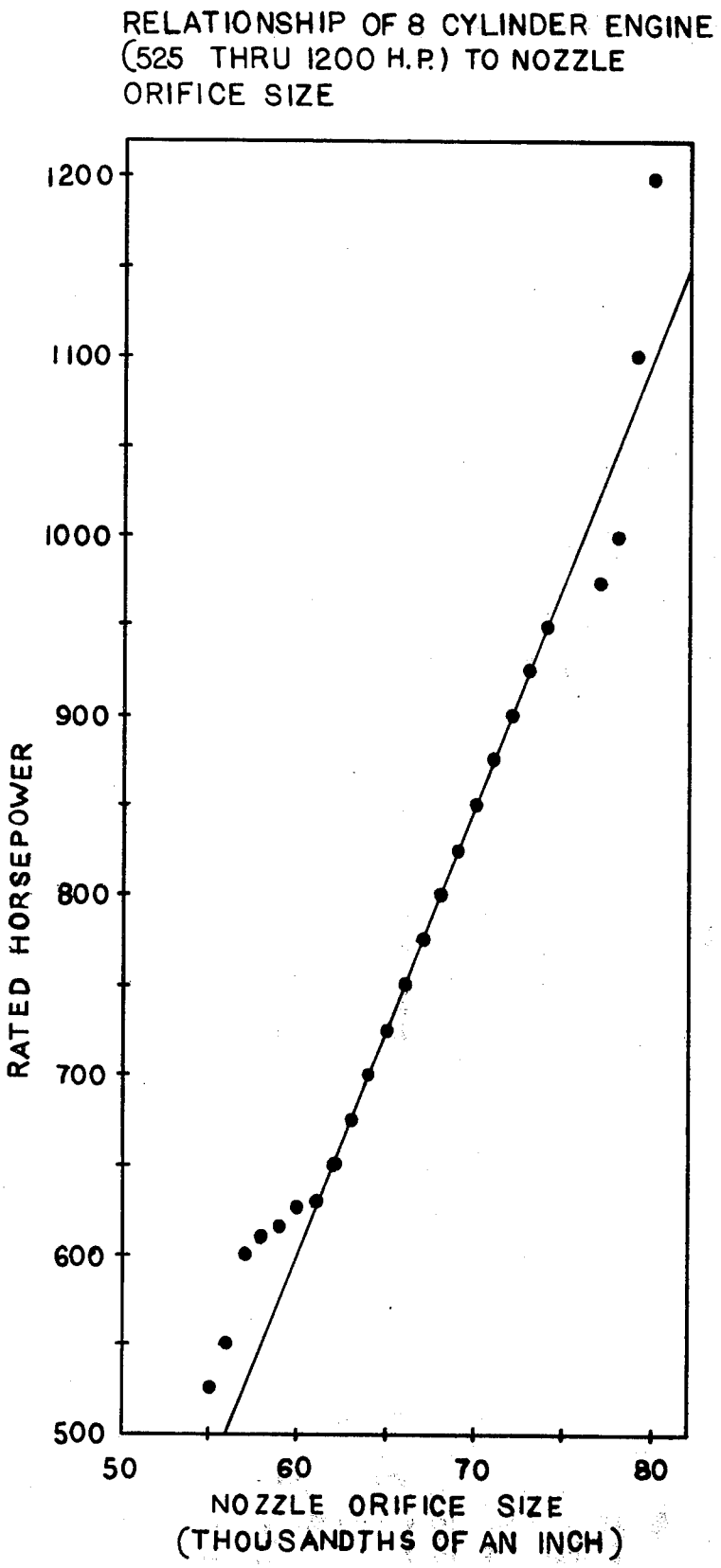
FIG. 17 is a similar graph for engines employed in 8-cylinder racing cars.

FIG. 20 illustrates schematically how the rate of emission of gasoline spray 162 from outlet orifice 48 of discharge nozzle 40 varies depending on the phase of the firing cycle of a given cylinder 140. As already indicated, there is a vacuum of at least about 21" of mercury present in manifold 134 and cylinder head intake chamber 142 of each cylinder at all times while the engine is running. The vacuum is present even while inlet valve 146 is closed during the compression, combustion, and exhaust phases of the firing cycle. During the intake phase of the firing cycle of a given cylinder, this vacuum is increased markedly when it is augmented by the vacuum produced within cylinder space 160 by retreating piston 158.

The intake phase of the firing cycle of a cylinder is designated 1 in FIG. 20, and the compression, combustion and exhaust phases are designated 2, 3, and 4, respectively. As would be expected, the highest rate of emission of the gasoline spray from the discharge nozzle is present when the highest vacuum is present in manifold 134 and cylinder head intake chamber 142, which is the case during the intake phase. This is shown at phase 1 in FIG. 20. As indicated, the rate of emission levels off and continues at about the same value during phases 2 through 4, the remainder of the firing cycle.

Configuration of Spray of Gasoline Droplets

As indicated in FIG. 18, the spray of gasoline droplets 162 that is emitted from outlet orifice 48 of discharge nozzle 40 is quite narrow in width. Outlet orifice 48 should be of such a size and configuration that the angle of flare of the spray measured from one side of the spray to the other at a distance from orifice 48 approximately equal to 40 times the diameter of the orifice and with its vertex at the orifice is no greater than about 10° when the nozzle is tested in an ambient vapor pressure of one atmosphere with gasoline introduced into the nozzle at the predetermined operating pressure of the fuel injection system of this invention. Although when the engine is in use the spray of droplets is introduced into a space in which there is a vacuum of 21" of mercury or below (depending on which phase of its firing cycle the cylinder is in), it is believed that the flare of the spray of droplets measured in an ambient vapor pressure of one atmosphere and with the liquid in the nozzle at its predetermined operating pressure will approximate the angle of flare produced under the actual operating conditions of the system. Improved combustion efficiency is obtained if the angle of flare as defined is no greater than about 5°, and it is preferred that it be no greater than about 2°.

As indicated at 168 in FIG. 18, the very great vacuum produced in cylinder space 160 during the intake phase of the firing cycle causes narrow spray 162 to bend quite sharply at 168 and be directed into valve opening 144. As suggested in the drawing, the spray of finely divided droplets of gasoline is substantially narrower, at the point where it passes through intake valve 144, than the diameter of that opening. It is preferred that spray 162/168 even be substantially narrower, as it passes through intake valve opening 144, than the radius of the annular opening that surrounds valve stem 148, or in other words substantially narrower than the radius of valve opening 144 minus the radius of stem 148 of inlet valve 146.

The small angle of flare and the narrow width of droplet spray 162/168 help to avoid letting any substantial number of droplets strike the interior walls of individual manifold passage 136 or intake port 42 during phases 2 to 4 of the firing cycle of the cylinder, or those walls and the interior walls of cylinder head intake chamber 142 or valve inlet opening 144 during phase 1. As a result, the surface upon which the spray impinges first after it leaves discharge nozzle 40 is at a temperature at or well above about 180°-200° F. This avoids the accumulation of a liquid film of gasoline on any of the interior walls referred to or upon the walls defining cylinder 140, which, as explained above, markedly increases the combustion efficiency of this fuel injection system.

Outlet orifice 48 of nozzle 40 may be located in individual passage 136 of intake manifold 134 as is shown in FIG. 18, or if desired it may be located right at intake port 42, or even within cylinder head intake chamber 142. The important thing is that discharge nozzle 40 and narrow spray 162 emitted from outlet orifice 48 of the nozzle be positioned with respect to intake port 42 so as to avoid bringing any substantial quantity of droplets into contact, during the respective phases of the firing cycle indicated, with the interior walls that define the passage and spaces described above.

Size of Outlet Orifices of Discharge Nozzles

The size of outlet port 60 of gasoline metering valve 32, the size of outlet orifices 48 of discharge nozzles 40, and the idle air setting of the carburetor or air intake means 130, as well as the pressure and flow rate at which fuel pump 24 is designed to operate, will together determine the type of combustion and resulting engine performance that is obtained with the fuel injection system of this invention.

With other things being equal, selection of the size of outlet orifices 48 for a given internal combustion engine will determine whether high performance with good acceleration or pick-up on the one hand, or fuel economy on the other hand, will be achieved. Variations in altitude will, as in every case, affect the operation of the gasoline engine, and the customary adjustments will be necessary in the idle adjustment screw to compensate for such changes in altitude. Thus, when the proper size hole for outlet orifices 48 has been determined for a given gasoline engine, thereafter the air control adjustment at carburetor or air intake means 130 will serve as the only necessary fine adjustment needed for maximum efficiency of the engine.

The proper size of outlet orifice 48 in discharge nozzle 40 depends upon the number of cylinders in the internal combustion engine, the engine size in terms of horsepower or engine displacement, the weight of any vehicle that is to be propelled by the engine or the power that is to be delivered by a stationary engine, and, as indicated, the desired balance of fuel economy and high engine performance. The precise size preferred for outlet orifice 48 may have to be determined experimentally, in the light of all these factors, for each engine, vehicle and desired type of performance.

However, preferred orifice sizes can be indicated with some degree of specificity for typical situations involving gasoline internal combustion engines of various types and various rated horsepowers or engine displacements. For most situations that are likely to be encountered, these indicated orifice sizes, or sizes no more than 10 percent above or below the indicated sizes, should provide a suitable balance of fuel economy and engine performance. Thus, when outlet orifices of "about" or "approximately" certain sizes are indicated in this specification and the attached claims as being preferred for engines of a particular type and rated horsepower or engine displacement, these terms are used to mean the indicated figures plus or minus 10 percent.

There is a minimum outlet orifice size for each internal combustion engine which will provide the necessary minimum amount of gasoline in order for the engine to operate. The smaller the increase in the orifice size above this minimum figure, the greater the fuel economy will be. On the other hand, generally speaking the larger the outlet orifice, the better the engine performance, unless the orifice size becomes so large that inefficient combustion and an undesirable level of fuel waste are produced. (Other things being equal, the outlet orifices will also be larger the higher the rated horsepower or engine displacement of the engine with which this fuel injection invention is used.)

Balancing these two objectives of fuel economy and engine performance, satisfactory results can usually be achieved with an automobile engine employing the fuel injection system of this invention with outlet orifices 48 of a diameter approximately as shown in the following tables:

TABLE 1

| LAWN MOWERS AND GO-CARTS | |
|---|---|
| RATED HORSEPOWER | ORIFICE SIZE (IN.) |
| 0.25 | 0.0005 |
| 0.33 | 0.0006 |
| 0.50 | 0.0007 |
| 1 | 0.0010 |
| 1.5 | 0.0012 |
| 2 | 0.0013 |
| 3 | 0.0014 |
| 4 | 0.0015 |
| 5 | 0.0016 |
| 6 | 0.0017 |
| 7 | 0.0018 |
| 8 | 0.0019 |
| 9 | 0.0020 |
| 10 | 0.0021 |
| 30 | 0.0022 |
| 40 | 0.0023 |
| 60 | 0.0024 |

TABLE 2

| MOTORCYCLES | |
|---|---|
| ENGINE SIZE (C.C.) | ORIFICE SIZE (IN.) |
| 1 Cylinder | |
| 50 | 0.0210 |
| 60 | 0.0220 |
| 70 | 0.0230 |
| 80 | 0.0240 |
| 90 | 0.0250 |
| 100 | 0.0260 |
| 2 Cylinders | |
| 150 | 0.0260 |
| 200 | 0.0270 |
| 350 | 0.0280 |
| 400 | 0.0290 |
| 450 | 0.0300 |
| 3 and 4 Cylinders | |
| 500 | 0.0310 |
| 550 | 0.0320 |
| 600 | 0.0330 |
| 650 | 0.0340 |
| 700 | 0.0350 |
| 750 | 0.0360 |
| 800 | 0.0370 |
| 850 | 0.0380 |
| 900 | 0.0390 |
| 1000 | 0.0400 |

TABLE 3

| 4-CYLINDER MOTOR VEHICLES | |
|---|---|
| RATED HORSEPOWER | ORIFICE SIZE (IN.) |
| 70 | 0.0250 |
| 75 | 0.0260 |
| 80 | 0.0270 |
| 85 | 0.0280 |
| 90 | 0.0290 |
| 100 | 0.0300 |

TABLE 4

| 6-CYLINDER MOTOR VEHICLES | |
|---|---|
| RATED HORSEPOWER | ORIFICE SIZE (IN.) |
| 90 | 0.0300 |
| 110 | 0.0310 |
| 120 | 0.0320 |
| 125 | 0.0330 |
| 130 | 0.0340 |

TABLE 5

| 8-CYLINDER STANDARD MOTOR VEHICLES | |
|---|---|
| RATED HORSEPOWER | ORIFICE SIZE (IN.) |
| 175 | 0.0300 |
| 250 | 0.0310 |
| 275 | 0.0320 |
| 300 | 0.0330 |
| 310 | 0.0350 |
| 325 | 0.0360 |
| 330 | 0.0370 |
| 350 | 0.0380 |
| 400 | 0.0390 |
| 425 | 0.0400 |

TABLE 6

| 8-CYLINDER RACING CARS | |
|---|---|
| RATED HORSEPOWER | ORIFICE SIZE (IN.) |
| 525 | 0.0550 |
| 550 | 0.0560 |
| 600 | 0.0570 |
| 610 | 0.0580 |
| 615 | 0.0590 |
| 625 | 0.0600 |
| 630 | 0.0610 |
| 650 | 0.0620 |
| 675 | 0.0630 |
| 700 | 0.0640 |
| 725 | 0.0650 |
| 750 | 0.0660 |
| 775 | 0.0670 |
| 800 | 0.0680 |
| 825 | 0.0690 |
| 850 | 0.0700 |
| 875 | 0.0710 |
| 900 | 0.0720 |
| 925 | 0.0730 |
| 950 | 0.0740 |
| 975 | 0.0770 |
| 1000 | 0.0780 |
| 1100 | 0.0790 |
| 1200 | 0.0800 |

The dimensions given in the tables above are believed to be accurate to within about 10 percent above or below the optimum diameter for the outlet orifices of the discharge nozzles in the fuel injection system of this invention for use with the indicated types and sizes of gasoline internal combustion engines. This is the meaning of the terms "about" and "approximately" when used in this specification and claims to indicate the preferred outlet orifice diameters.

It should be understood that these preferred figures are given for typical engines of the sizes and types described, and some adjustment may be necessary after experimentation with any engines that depart from typical construction in some material way. In addition, it must be understood that the preferred diameters given are stated for a desired balance of fuel economy and high performance for the particular engines referred to. Thus, if more fuel economy is desired, the outlet orifice diameter may be reduced somewhat, and if more power is desired, the outlet orifice diameter may be increased somewhat from the indicated figures.

The preferred orifice sizes indicated in the tables above apply to typical motor vehicles of the indicated types and rated horsepowers when operated with a typical adjustment of by-pass valve 88 containing a "pill" 98 of customary size.

The information contained in Tables 1 through 6 above has been plotted in the graphs included as FIGS. 12 through 17, respectively. By determining the respective slopes of the lines most closely approximating the resulting plotted points, the following formulas for orifice diameter "d" have been computed for use with the fuel injection system of this invention in engines having rated horsepowers "H.P.":

Lawn Mowers and Go-carts $d = 0.0005'' + (\text{H.P.} - 0.25/2{,}200)''$ for engines of rated horsepower between about 0.25 and about 2.0.

$d = 0.0013'' + (\text{H.P.} - 2.0/10{,}000)''$ for engines of rated horsepower between about 2.0 and about 10.0.

$d = 0.0021'' + (\text{H.P.} - 10.0/16{,}700)$ for engines of rated horsepower above about 10.0.

Motorcycles $d = 0.021'' + (\text{c.c.} - 50/620)''$ for engines of engine displacement between about 50 c.c. and about 100 c.c.

$d = 0.026'' + (\text{c.c.} - 100/7{,}150)''$ for engines of engine displacement between about 100 c.c. and about 350 c.c.

$d = 0.028'' + (\text{c.c.} - 350/3{,}050)''$ for engines of engine displacement above about 350 c.c.

4-Cylinder Motor Vehicles $d = 0.024'' + (\text{H.P.} - 65/5{,}000)''$

6-Cylinder Motor Vehicles $d = 0.0284'' + (\text{H.P.} - 80/9{,}800)''$

8-Cylinder Standard Motor Vehicles $d = 0.026'' + (\text{H.P.} - 100/23{,}300)''$ 8-Cylinder Racing Cars $d = 0.056'' + (\text{H.P.} - 650/250{,}000)''$ A satisfactory balance of high engine performance and fuel economy can be obtained with the size of the outlet orifices of the discharge nozzles being approximately the size indicated in the following examples for typical automobiles of the kinds specified:

EXAMPLE 1

4 cylinder American compact automobile
1600 c.c. with 70 H.P.
Outlet orifice size — 0.025" diameter

EXAMPLE 2

6 cylinder American compact automobile
292 cu. in. engine displacement with 110 H.P.
Outlet orifice size — 0.031" diameter

EXAMPLE 3

8 cylinder American standard size automobile
327 cu. in. engine displacement with 400 H.P.
Outlet orifice size — 0.039" diameter Operation of Engine Since the fuel injection system of this invention operates under pressure from fuel pump 24, the operator of the engine must remember that with an electric fuel pump, when the ignition key is turned to the "On" position and the fuel pump thereby activated, gasoline will be pumped throughout the system and reach discharge nozzles 40. For this reason, when the engine is being started, the ignition key should be turned only momentarily into the conventional "On" position, and then should be turned to the full clockwise "Crank" position. With the ignition key in this latter position, the engine will be cranked and the sparking system actuated, so that the engine can catch and begin to fire, but no additional gasoline will be injected into the engine cylinders so long as the key remains in the "Crank" position.

If the ignition key is left in the conventional "On" position for more than a brief time with an electric fuel pump, the engine may flood and fail to operate. If the flooding is not too serious, the operator can wait a short while to let the fine mist of gasoline droplets from discharge nozzles 40 settle in the cylinders, after which the key can be turned to the "Crank" position to cause the cyliners to start to fire. If the ignition key has been left too long in the "On" position, however, the gasoline forced through the system by the operation of the fuel pump will increase to such an amount, and the resulting flooding of the engine cylinders will be so extensive, that the gasoline will leak into the oil system and require replacement of the oil.

The fuel injection system of this invention has all the advantages of other fuel injection systems in comparison to carburetor fuel systems, including efficient fuel combustion, elimination of stalling due to icing, and prevention of "dieseling" when the ignition is turned off. In addition, the system has marked advantages of simplicity and economy in comparison to other fuel injection systems, since it has only one rotatable part (hollow sleeve 60) and only a few mechanical adjustments are required to bring the system into the desired balance of engine performance and fuel economy.

The above detailed description has been given for ease of understanding only. No unnecessary limitations should be derived therefrom, as modifications will be obvious to those skilled in the art.

What is claimed is:

1. A system for converting a gasoline internal combustion engine, said engine being used with a gasoline tank and with a fuel pump for pumping gasoline from said tank at a given pressure with a substantially constant rate of flow, and having a carburetor actuated by a throttle rod, said throttle rod being movable from a closed to an open position to move a throttle valve from a closed to an open position and thereby deliver a mixture of air and gasoline to each cylinder of the engine, into an engine having a fuel injection system actuated by said throttle rod which comprises:

(a) a discharge nozzle for each cylinder of said internal combustion engine, each of said nozzles including a hollow shank having an inlet opening at one end communicating between the exterior and the interior of the hollow shank, the other end of said nozzle shank being closed except for a cylindrically shaped outlet orifice in the wall of the shank, said orifice providing a free and direct liquid flow path at all times from the interior to the exterior of said hollow shank for emission of a narrow spray of finely divided liquid droplets from said discharge nozzle when gasoline under a predetermined operating pressure is introduced into said hollow shank through said inlet opening, said narrow spray having an angle of flare, measured from one side of the spray to the other at a distance from said orifice approximately equal to 40 times the diameter of the orifice and with its vertex at said orifice, that is no greater than about 10° when said nozzle is tested in an ambient vapor pressure of 1 atmosphere with gasoline introduced into the nozzle at said predetermined operating pressure;

(b) a fitting for positioning each discharge nozzle in selective fluid communication with the interior of a given cylinder to project the narrow spray of finely divided liquid droplets emitted from said nozzle into a cylinder head intake chamber for said cylinder along a path that avoids bringing any substantial quantity of said droplets into contact with the interior walls that define said cylinder's individual passage in an intake manifold of said engine and its associated intake port;

(c) a single, adjustable gasoline metering valve actuatable by movement of said throttle rod, said valve having an inlet opening for receiving gasoline under said given pressure from said fuel pump, and an outlet opening from which metered amounts of gasoline may flow, the amount of gasoline that is permitted to pass through said adjustable metering valve at any given moment being determined by the position occupied by said throttle rod at said moment;

(d) means for operatively connecting said adjustable gasoline metering valve and said throttle rod to increase, in response to movement of said throttle rod from its closed to its open position, the rate at which gasoline flowing under pressure from said fuel pump is permitted to pass through said metering valve and out of its said outlet opening, and to decrease said rate of flow in response to movement of the throttle rod in the opposite direction;

(e) a gasoline distribution block having a single inlet opening, a central chamber in direct communication with said inlet opening, and a plurality of outlet openings equal in number of the number of cylinders in said internal combustion engine, all of said outlet openings having equal cross-sectional areas, said distribution block having a plurality of internal passageways each of which is at all times in direct fluid communication at one end with said central chamber and at the other end with a single one of said plurality of outlet openings to conduct to each of said outlet openings, when said chamber is filled with gasoline, a substantially equal fraction of the gasoline introduced under pressure into said single inlet opening of the distribution block;

(f) conduit means for connecting the outlet opening of said gasoline metering valve directly with the inlet opening of said gasoline distribution block;

(g) conduit means for connecting each of said outlet openings in said distribution block directly to one of the aforesaid discharge nozzles to deliver to said nozzle a metered flow of gasoline under a predetermined operating pressure;

(h) a return fuel line for connection to said gasoline tank to conduct back to said tank any excess, unused gasoline that is pumped from said fuel pump to said adjustable metering valve but because of the action of said metering valve is not permitted to pass through said valve; and (i) a pressure responsive by-pass valve for connecting the upstream side of said adjustable metering valve with said return fuel line, said by-pass valve allowing the passage of liquid substantially at said given pressure at which gasoline is delivered from said fuel-pump to said gasoline metering valve at said substantially constant rate, and blocking the passage of liquid at pressures substantially below said given pressure, whereby the rate at which said narrow sprays of finely divided liquid droplets of gasoline are emitted from said discharge nozzles of the engine is substantially the same for all said nozzles during the intake phase of the firing cycle of the respective cylinders with which the nozzles are associated, and likewise is substantially the same for all said nozzles during the remainder of the firing cycle of their respective cylinders, and no substantial quantity of liquid gasoline accumulates on or flows down said interior walls that define said individual passages in the intake manifold and said intake ports or accumulates on or flows down the interior walls of said cylinders themselves.

2. The conversion system of claim 1 in which said angle of flare of said narrow spray of finely divided liquid droplets is no greater than about 5° when said nozzle is tested in an ambient vapor pressure of 1 atmosphere with gasoline introduced into the nozzle at said predetermined operating pressure.

3. The conversion system of claim 2 in which said fitting for each of said discharge nozzles positions said nozzle with its outlet orifice within the cylinder head intake chamber of the cylinder with the interior of which said nozzle is in selective fluid communication, to project said narrow spray of finely divided liquid droplets directly into said cylinder head intake chamber.

4. The conversion system of claim 2 in which said fitting for each of said discharge nozzles positions said nozzle with its outlet orifice within said individual passage in the intake manifold that leads to the cylinder with the interior of which said nozzle is in selective fluid communication, and adjacent the intake port for said cylinder, to project the narrow spray of finely divided liquid droplets emitted from said nozzle directly through said intake port and into the cylinder head intake chamber of said cylinder along a path that avoids bringing any substantial quantity of said droplets into contact with the interior walls that define said individual passage and said intake port.

5. The conversion system of claim 2 which includes pressure regulator means for incorporation in the conduit leading from said fuel pump to said gasoline receiving inlet in said metering valve to restrict the pressure at which gasoline is delivered to said valve from said fuel pump to a pressure of no more than about 15 p.s.i.g. for automotive ground vehicles of standard speed and acceleration, no more than about 30 p.s.i.g. for airplanes, and no more than about 50 p.s.i.g. for racing cars.

6. The conversion system of claim 2 which includes pressure regulator means for incorporation in the conduit leading from said fuel pump to said gasoline receiving inlet in said metering valve to restrict the pressure at which gasoline is delivered to said valve from said fuel pump to a pressure of no more than about 7 p.s.i.g. for automotive ground vehicles of standard speed and acceleration, no more than about 20 p.s.i.g. for airplanes, and no more than about 40 p.s.i.g. for racing cars.

7. The conversion system of claim 2 in which the outlet orifice of each of said discharge nozzles, when the nozzle is filled with gasoline introduced into the nozzle at said predetermined operating pressure and it is tested in an ambient vapor pressure of one atmosphere, emits a narrow spray of finely divided liquid droplets that has an angle of flare, measured from one side of the spray to the other at a distance from said orifice approximately equal to 40 times the diameter of the orifice and with its vertex at said orifice, that is no greater than about 2°.

8. The conversion system of claim 2 in which said fitting for each of said discharge nozzles positions said nozzle to project said narrow spray of finely divided droplets of gasoline along a path that brings said droplets, during the time interval in which they are subjected to the action of the vacuum produced by the withdrawing of the piston in the intake phase of the firing cycle of the cylinder with the interior of which said nozzle is in selective fluid communication, directly through an intake valve opening of said cylinder without any substantial number of the droplets striking the interior walls that define said cylinder head intake chamber, and in which said spray of finely divided droplets is substantially narrower, at the point where it passes into said cylinder through said intake valve opening, than the diameter of said opening.

9. The conversion system of claim 8 in which said intake valve opening has associated therewith an intake valve having a stem and in which the outlet orifice of said discharge nozzle emits a spray of finely divided droplets that is substantially narrower, at the point where it passes through said intake valve opening, than the radius of said valve opening minus the radius of the stem of said intake valve.

10. The conversion system of claim 2 in which the outlet orifice of each of said discharge nozzles has a diameter falling in the range from about 0.0005" to the maximum diameter at which the capillary action between the walls defining said orifice and the gasoline contained in said orifice prevents the flow of gasoline therefrom when said outlet orifice is facing in a generally downward direction and the liquid inside said discharge nozzle is at the same pressure as the vapor pressure outside said nozzle, said outlet orifice diameter being the same for each cylinder of a given engine.

11. The conversion system of claim 2 for use with a fuel pump that delivers gasoline to said metering valve at a pressure of about 7 p.s.i.g. in which the outlet orifices of said discharge nozzles have diameters falling in the range between about 0.0005" to about 0.055", with said outlet orifice diameter being the same for each cylinder of a given engine.

12. The conversion system of claim 2 for use with a fuel pump that delivers gasoline to said metering valve at a pressure of about 7 p.s.i.g. in which the outlet orifices of said discharge nozzles have diameters falling in the range between about 0.055" to about 0.080", with said outlet orifice diameter being the same for each cylinder of a given engine.

13. The conversion system of claim 2 for installation in a gasoline internal combustion engine for a lawn mower or a go-cart in which the outlet orifice of each of said discharge nozzles has a diameter falling in the range from about 0.0005" to about 0.0024", with said diameter being approximately equal to 0.0005" + (H.P. − 0.25/2,200)" for engines having a rated horsepower between about 0.25 and about 2.0, 0.0013" + (H.P. − 2.0/10,000)" for engines having a rated horsepower between about 2.0 and about 10.0, and 0.0021" + (H.P. − 10.0/16,700)" for engines having a rated horsepower above about 10.0, where "H.P. " represents the rated horsepower of the engine in question.

14. The conversion system of claim 2 for installation in a gasoline internal combustion engine for a motorcycle in which the outlet orifice of each of said discharge nozzles has a diameter falling in the range from about 0.021" to about 0.040", with said diameter being approximately equal to 0.021" + (c.c. − 50/10,000)" for engines having an engine displacement between about 50 c.c. and about 100 c.c., 0.026" + (c.c. − 100/125,000)" for engines having an engine displacement between about 100 c.c. and about 350 c.c., and 0.028" + (c.c. − 350/50,000) for engines having an engine displacement above about 350 c.c., where "c.c." represents the engine displacement of the engine in question expressed in cubic centimeters.

15. The conversion system of claim 2 for installation in a standard 4-cylinder gasoline internal combustion engine in which the diameter of the outlet orifice of each of said discharge nozzles is approximately equal to 0.024" + (H.P. − 65/5,000)" where "H.P." represents the rated horsepowder of the engine in question.

16. The conversion system of claim 2 of installation in a standard 6-cylinder gasoline internal combustion engine in which the diameter of the outlet orifice of each of said discharge nozzles is approximately equal to 0.0284" + (H.P. − 80/9,800)", where "H.P." represents the rated horsepower of the engine in question.

17. The conversion system of claim 2 for installation in an 8-cylinder gasoline internal combustion engine providing standard speed and acceleration in which the diameter of the outlet orifice of each of said discharge nozzles is approximately equal to 0.026" + (H.P. − 100/23,300)", where "H.P." represents the rated horsepower of the engine in question.

18. The conversion system of claim 2 for installation in a gasoline internal combustione engine for an 8-cylinder racing car in which the diameter of the outlet orifice of each of said discharge nozzles is approximately equal to 0.056" + (H.P. − 650/250,000)", where "H.P." represents the rated horsepower of the engine in question.

19. The conversion system of claim 2 in which the mean direction of discharge of said fine spray of droplets from said outlet orifice in the wall of the hollow shank of each of said discharge nozzles is generally perpendicular to the longitudinal axis of said hollow shank.

20. The conversion system of claim 3 in which each of said discharge nozzles is generally J-shaped and the side wall of the nozzle defines said outlet orifice.

21. The conversion system of claim 4 in which each of said discharge nozzles is elongated in shape and the side wall of the nozzle defines said outlet orifice.

22. The conversion system of claim 2 in which the exterior wall of said hollow shank of each of said discharge nozzles has the form of a right circular cylinder.

23. The conversion system of claim 2 in which said adjustable gasoline metering valve comprises a body member, said body having a cylindrical cavity therein, said cavity having an inlet passage and an outlet passage, both providing fluid communication from said cavity to the exterior of said body, said body defining journal means communicating with the exterior of said body, a hollow sleeve member rotatably positioned within and complementary in shape to said cavity, one end of said hollow sleeve communicating with said inlet passage of said body member and the other end terminating in a shank adapted to rotate within said journal means, said sleeve having in its side wall an outlet port movable into and out of register with said outlet passage of said body member as said sleeve is rotated first in one direction and then the other about its longitudinal axis; means connected with said sleeve shank for rotating said sleeve member about its longitudinal axis; and means for attaching said last mentioned means to the throttle rod associated with said gasoline internal combustion engine.

24. In a gasoline internal combustion engine, a fuel injection system for delivering a mixture of air and a spray of finely divided gasoline droplets to each cylinder of said gasoline internal combustion engine, which engine is used with a gasoline tank and with a movable throttle rod, which comprises:

(a) a fuel pump for delivering a flow of gasoline from said tank at a given pressure with a substantially constant rate of flow;

(b) a discharge nozzle in selective fluid communication with the interior of each cylinder of said internal combustion engine, each of such nozzles including a hollow shank having an inlet opening at one end communicating between the exterior and the interior of the hollow shank, the other end of said nozzle shank being closed except for a cylindrically shaped outlet orifice in the wall of the shank, said orifice providing a free and direct liquid flow path at all times from the interior to the exterior of said hollow shank, for emission of a narrow spray of finely divided liquid droplets from said discharge nozzle when gasoline under a predetermined operating pressure is introduced into said hollow shank through said inlet opening, said narrow spray having an angle of flare, measured from one side of the spray to the other at a distance from said orifice approximately equal to 40 times the diameter of the orifice and with its vertex at said orifice, that is no greater than about 10° when said nozzle is tested in an ambient vapor pressure of one atmosphere with gasoline introduced into the nozzle at said predetermined operating pressure; each of said nozzles being positioned to project the narrow spray of finely divided liquid droplets emitted from the outlet orifice of said nozzle into a cylinder head intake chamber for said cylinder along a path that avoids bringing any substantial quantity of said droplets into contact with the interior walls that define said cylinder's individual passage in an air intake manifold of said engine and its associated intake port;

(c) a single, adjustable gasoline metering valve actuatable by movement of said throttle rod, said valve having an inlet opening for receiving gasoline under said given pressure from said fuel pump, and an outlet opening from which metered amounts of gasoline may flow, the amount of gasoline that is permitted to pass through said adjustable metering valve at any given moment being determined by the position occupied by said throttle rod at said moment;

(d) means operatively conecting said adjustable gasoline metering valve and said throttle rod to increase, in response to movement of said throttle rod in one direction, the rate at which gasoline flowing under pressure from said fuel pump is permitted to pass through said metering valve and out of its said outlet opening, and to decrease said rate of flow in response to movement of the throttle rod in the opposite direction;

(e) a gasoline distribution block having a single inlet opening, a central chamber in direct communication with said inlet opening, and a plurality of outlet openings equal in number to the number of cylinders in said internal combustion engine, all of said outlet openings having equal cross-sectional areas, said distribution block having a plurality of internal passageways each of which is at all times in direct fluid communication at one end with said central chamber and at the other end with a single one of said plurality of outlet openings to conduct to each of said outlet openings, when said central chamber is filled with gasoline, a substantially equal fraction of the gasoline introduced under pressure into said single inlet opening of the distribution block;

(f) conduit means for connecting the outlet opening of said gasoline metering valve directly with the inlet opening of said gasoline distribution block;

(g) conduit means for connecting each of said outlet openings in said distribution block directly to one of the aforesaid discharge nozzles to deliver to said nozzle a metered flow of gasoline under a predetermined operating pressure;

(h) a return fuel line connected to said gasoline tank for conducting back to said tank any excess, unused gasoline that is pumped from said fuel pump to said adjustable metering valve but because of the action of said metering valve is not permitted to pass through said valve;

(i) a pressure responsive by-pass valve connecting the upstream side of said adjustable metering valve with said return fuel line, said by-pass valve allowing the passage of liquid substantially at said given pressure at which gasoline is delivered from said fuel pump to said gasoline metering valve at said substantially constant rate, and blocking the passage of liquid at pressures substantially below said given pressure;

(j) air intake means for delivering air to all said cylinders at a substantially equal rate; and (k) means to increase said air delivery rate in response to movement of said throttle rod in said one direction, and to decrease said delivery rate in response to movement of the throttle rod in the opposite direction, whereby the rate at which said narrow sprays of finely divided liquid droplets of gasoline are emitted from said discharge nozzles of the engine is substantially the same for all said nozzles during the intake phase of the firing cycle of the respective cylinders with which the nozzles are associated, and likewise is substantially the same for all said nozzles during the remainder of the firing cycle of their respective cylinders, and no substantial quantity of said gasoline accumulates on or flows down said interior walls that define said individual passages in the intake manifold and said intake ports or accumulates or flows down the interior walls of said cylinders themselves.

25. The fuel injection system of claim 24 in which said angle of flare of said narrow spray of finely divided liquid droplets is no greater than about 5° when said nozzle is tested in an ambient vapor pressure of 1 atmosphere with gasoline introduced into the nozzle at said predetermined operating pressure.

26. The fuel injection system of claim 25 in which said outlet orifice of each of said nozzles is positioned within the cylinder head intake chamber of the cylinder with the interior of which said nozzle is in selective fluid communication, to project said narrow spray of finely divided liquid droplets directly into said cylinder head intake chamber.

27. The fuel injection system of claim 25 in which said outlet orifice of each of said nozzles is positioned within said individual passage in the air intake manifold that leads to the cylinder with the interior of which said nozzle is in selective fluid communication and adjacent the intake port for said cylinder to project the narrow spray of finely divided liquid droplets emitted from said nozzle directly through said intake port and into the cylinder head intake chamber of said cylinder along a path that avoids bringing any substantial quantity of said droplets into contact with the interior walls that define said individual passage and said intake port.

28. The fuel injection system of claim 25 in which said fuel pump delivers gasoline to said metering valve at a pressure of no more than about 15 p.s.i.g. in any such system used in an automotive ground vehicle of standard speed and acceleration, no more than about 30 p.s.i.g. in any such system used in an airplane, and no more than about 50 p.s.i.g. in any such system used in a racing car.

29. The fuel injection system of claim 25 in which said fuel pump delivers gasoline to said metering valve at a pressure of no more than about 7 p.s.i.g. in any such system used in an automotive ground vehicle of standard speed and acceleration, no more than about 20 p.s.i.g. in any such system used in an airplane, and no more than about 40 p.s.i.g. in any such system used in a racing car.

30. The fuel injection system of claim 25 in which the outlet orifice of each of said discharge nozzles, when the nozzle is filled with gasoline introduced into the nozzle at said predetermined operating pressure and it is tested in an ambient vapor pressure of one atmosphere, emits a narrow spray of finely divided liquid droplets that has an angle of flare, measured from one side of the spray to the other at a distance from said orifice approximately equal to 40 times the diameter of the orifice and with its vertex at said orifice, that is no greater than about 2°.

31. The fuel injection system of claim 25 in which the outlet orifice of each of said discharge nozzles is positioned to project said narrow spray of finely divided droplets of gasoline along a path that brings substantially all of said spray, during the time interval in which it is subjected to the action of the vacuum produced by the withdrawing of the piston in the intake phase of the firing cycle of the cylinder with the interior of which said nozzle is in selective fluid communication, directly through an intake valve opening of said cylinder without striking the interior walls that define said cylinder head intake chamber, and in which said spray of finely divided droplets is substantially narrower, at the point where it passes through said intake valve opening, than the diameter of said opening.

32. The fuel injection system of claim 31 in which said intake valve opening has associated therewith an intake valve having a stem and in which the outlet orifice of said discharge nozzle emits a spray of finely divided droplets that is substantially narrower, at the point where it passes through said intake valve opening, than the radius of said valve opening minus the radius of the stem of said intake valve.

33. The fuel injection system of claim 25 in which the outlet orifices of each of said discharge nozzles has a diameter falling in the range from about 0.0005" to the maximum diameter at which the capillary action between the walls defining said orifice and the gasoline contained therein prevents the flow of gasoline therefrom when said outlet orifice is facing in a generally downward direction and the liquid inside said discharge nozzle is at the same pressure as the vapor pressure outside said nozzle, said outlet orifice diameter being the same for each cylinder of a given engine.

34. The fuel injection system of claim 25 in which gasoline is delivered to said nozzles at a pressure of about 7 p.s.i.g. and the outlet orifices of said discharge nozzles have diameters falling in the range between about 0.0005" to about 0.055", with said outlet orifice diameter being the same for each cylinder of a given engine.

35. The fuel injection system of claim 25 in which gasoline is delivered to said nozzles at a pressure of about 7 p.s.i.g. and the outlet orifices of said discharge nozzles have diameters falling in the range between about 0.555" to about 0.080", with said outlet orifice diameter being the same for each cylinder of a given engine.

36. The fuel injection system of claim 25 for use in a gasoline internal combustion engine for a lawn mower or a go-cart in which the outlet orifices of each of said discharge nozzles has a diameter falling in the range from about 0.0005" to about 0.0024", with said diameter being approximately equal to 0.0005" + (H.P. − 0.25/2,200)" for engines having a rated horsepower between about 0.25 and about 2.0, 0.0013" + (H.P. − 2.0/10,000)" for engines having a rated horsepower between about 2.0 and about 10.0, and 0.0021" + (H.P. − 10.0/16,700)" for engines having a rated horsepower above about 10.0, where "H.P." represents the rated horsepower of the engine in question.

37. The fuel injection system of claim 25 for use in a gasoline internal combustion engine for a motorcycle in which the outlet orifice of each of said discharge nozzles has a diameter falling in the range from about 0.021" to about 0.040", with said diameter being approximately equal to 0.21" + (c.c − 50/10,000)" for engines having an engine displacement between about 50 c.c. and about 100 c.c., 0.026" + (c.c. − 100/125,000)" for engines having an engine displacement between about 100 and about 350 c.c., and 0.028" + (c.c. − 350/50,000)" for engines having an engine displacement about about 350 c.c., where "c.c." represents the engine displacement of the engine in question expressed in cubic centimeters.

38. The fuel injection system of claim 25 for use in a standard 4-cylinder gasoline internal combustion engine in which the diameter of the outlet orifice of each of said discharge nozzles is approximately equal to 0.024" + (H.P. − 65/5,000)", where "H.P." represents the rated horsepower of the engine in question.

39. The fuel injection system of claim 25 for use in a standard 6-cylinder gasoline internal combustion engine in which the diameter of the outlet orifice of each of said discharge nozzles is approximately equal to 0.0284" + (H.P. − 80/9,800)", where "H.P." represents the rated horsepower of the engine in question.

40. THe fuel injection system of claim 25 for use in an 8-cylinder gasoline internal combustion engine providing standard speed and acceleration in which the diameter of the outlet orifice of each of said discharge nozzles is approximately equal to 0.026" + (H.P. − 100/23,300)", where "H.P." represents the rated horsepower of the engine in question.

41. The fuel injection system of claim 25 for use in a gasoline internal combustion engine for an 8-cylinder racing car in which the diameter of the outlet orifice of each of said discharge nozzles is approximately equal to 0.056" + (H.P. − 650/250,000)", where "H.P." represents the rated horsepower of the engine in question.

42. The fuel injection system of claim 25 in which the mean direction of discharge of said fine spray of droplets from said outlet orifice in the wall of the hollow shank of each of said discharge nozzles is generally perpendicular to the longitudinal axis of said hollow shank.

43. The fuel injection system of claim 26 in which each of said discharge nozzles is generally J-shaped and the side wall of the nozzle defines said outlet orifice.

44. The fuel injection system of claim 27 in which each of said discharge nozzles is elongated in shape and the side wall of the nozzle defines said outlet orifice.

45. The fuel injection system of claim 25 in which the exterior wall of said hollow shank of each of said discharge nozzles has the form of a right circular cylinder.

46. The fuel injection system of claim 25 in which said adjustable gasoline metering valve comprises a body member, said body having a cylindrical cavity therein, said cavity having an inlet passage and an outlet passage, both providing fluid communication from said cavity to the exterior of said body, said body defining journal means communicating with the exterior of said body; a hollow sleeve member rotatably positioned within and complementary in shape to said cavity, one end of said hollow sleeve communicating with said inlet passage of said body member and the other end terminating in a shank adapted to rotate within said journal means, said sleeve having in its side wall an outlet port adapted to move into and out of register with said outlet passage of said body member as said sleeve is rotated first in one direction and then the other about its longitudinal axis; means connected with said sleeve shank for rotating said sleeve member about its longitudinal axis; and means for attaching said last mentioned means to the throttle rod associated with said gasoline internal combustion engine.

* * * * *